US007371141B1

(12) United States Patent
Lin

(10) Patent No.: US 7,371,141 B1
(45) Date of Patent: May 13, 2008

(54) LEASH MOUNT FOR FLOATING BOARDS

(76) Inventor: Henkel Lin, No. 13, Lane 130, Kung-An Rd., Houli Hsiang, Taichung Hsien (TW)

( * ) Notice: Subject to any disclaimer, the term of this patent is extended or adjusted under 35 U.S.C. 154(b) by 0 days.

(21) Appl. No.: 11/778,063

(22) Filed: Jul. 15, 2007

(51) Int. Cl.
*B63B 35/00* (2006.01)

(52) U.S. Cl. ..... 441/75

(58) Field of Classification Search ..... 441/74, 441/75; 24/104, 107, 108
See application file for complete search history.

(56) References Cited

U.S. PATENT DOCUMENTS 4,267,615 A * 5/1981 Nealy ..... 441/75
5,127,861 A * 7/1992 Ross ..... 441/75
5,137,483 A * 8/1992 Nealy ..... 441/75
5,154,655 A * 10/1992 Glydon ..... 441/75
5,338,237 A * 8/1994 Nealy ..... 441/74
6,102,761 A * 8/2000 Fleming ..... 441/75
2006/0025028 A1* 2/2006 Chen et al. ..... 441/75

* cited by examiner

*Primary Examiner*—Ed Swinehart
(74) *Attorney, Agent, or Firm*—Pai Patent & Trademark Law Firm; Chao-Chang David Pai

(57) ABSTRACT

A leash mount for floating boards has a base and a cap. The base has a seat and a connecting assembly protruding from the seat. The connecting assembly is has a connecting tube and a leash tie hole. The connecting tube has at least one pair of mounting recesses. The pairs of mounting recesses are formed diametrically on the connecting tube. The cap is rotatably mounted detachably in the connecting tube and has multiple bosses. The bosses correspond to and are mounted in the mounting recesses to hold the leash mount securely. Therefore, a leash tie can be mounted on a surfboard through the leash tie hole of the leash mount easily and securely whilst being remolded quickly for cleaning or maintenance.

10 Claims, 7 Drawing Sheets

LEASH MOUNT FOR FLOATING BOARDS

BACKGROUND OF THE INVENTION

1. Field of Invention

The present invention relates to a leash mount, and more particularly to a leash mount that connects a leash to a floating board.

2. Description of the Related Art

Floating boards are used at the beach or swimming pools and include surfboards, bodyboards, skin boards and the like, where a person, stands, sits or lies on the floating board. For convenience and safety, a leash is attached to the board and detachably to the person in case they fall off the floating board.

With reference to FIG. 9, a floating board (61) is implemented with a leash (60) mounted through the floating board (61). The leash (60) has a bolt (623), a nut (624) and a rope (625). The bolt (623) is mounted in the floating board (61). The nut (624) has a head, a neck (6241) and a rope mounting hole (6242). The neck (6242) is tubular, corresponds to and is mounted rotatably on the bolt (623), is formed coaxially on and protrudes from the base and has an inner surface and a thread formed on the inner surface of the neck (6242). The rope mounting hole (6242) is formed through the head of the nut (624).

The rope (625) has a connecting end that is inserted through the rope mounting hole (6242) and wound around the neck (6241) before the nut (624) is mounted on the bolt (623) that is held securely once the bolt (623) is tightened. Therefore, a person can attach the rope (625) to prevent the floating board (61) from causing harm to other people in the water, damaging or losing of the floating device (61).

However, assemble and disassemble of the leash (60), required for regular maintenance and cleaning, is complicated since the rope (625) must be wound around the neck (6241). Furthermore, if the rope (625) is not wound properly around the neck, the rope (625) may unexpectedly detach from the floating device (61) causing harm to other people in the water, damaging or leading to the loss of the floating device (61).

The present invention provides a leash mount to obviate or mitigate the shortcomings of the conventional leash mount for a surfboard.

SUMMARY OF THE INVENTION

The primary objective of the present invention is to provide a leash mount for floating boards that allows a leash to be mounted on floating boards easily and securely.

The leash mount for floating boards has a base and a cap. The base has a seat and a connecting assembly protruding from the seat. The connecting assembly has a connecting tube and a leash tie hole. The connecting tube has at least one pair of mounting recesses. The pairs of mounting recesses are formed diametrically on the connecting tube. The cap is rotatably mounted detachably in the connecting tube and has multiple bosses. The bosses correspond to and are mounted in the mounting recesses to hold the leash mount securely. Therefore, a leash tie can be mounted on a surfboard through the leash tie hole of the leash mount easily and securely whilst being removed quickly for cleaning and maintenance.

Other objectives, advantages and novel features of the invention will become more apparent from the following detailed description when taken in conjunction with the accompanying drawings.

DETAILED DESCRIPTION OF THE INVENTION

Figure 1:
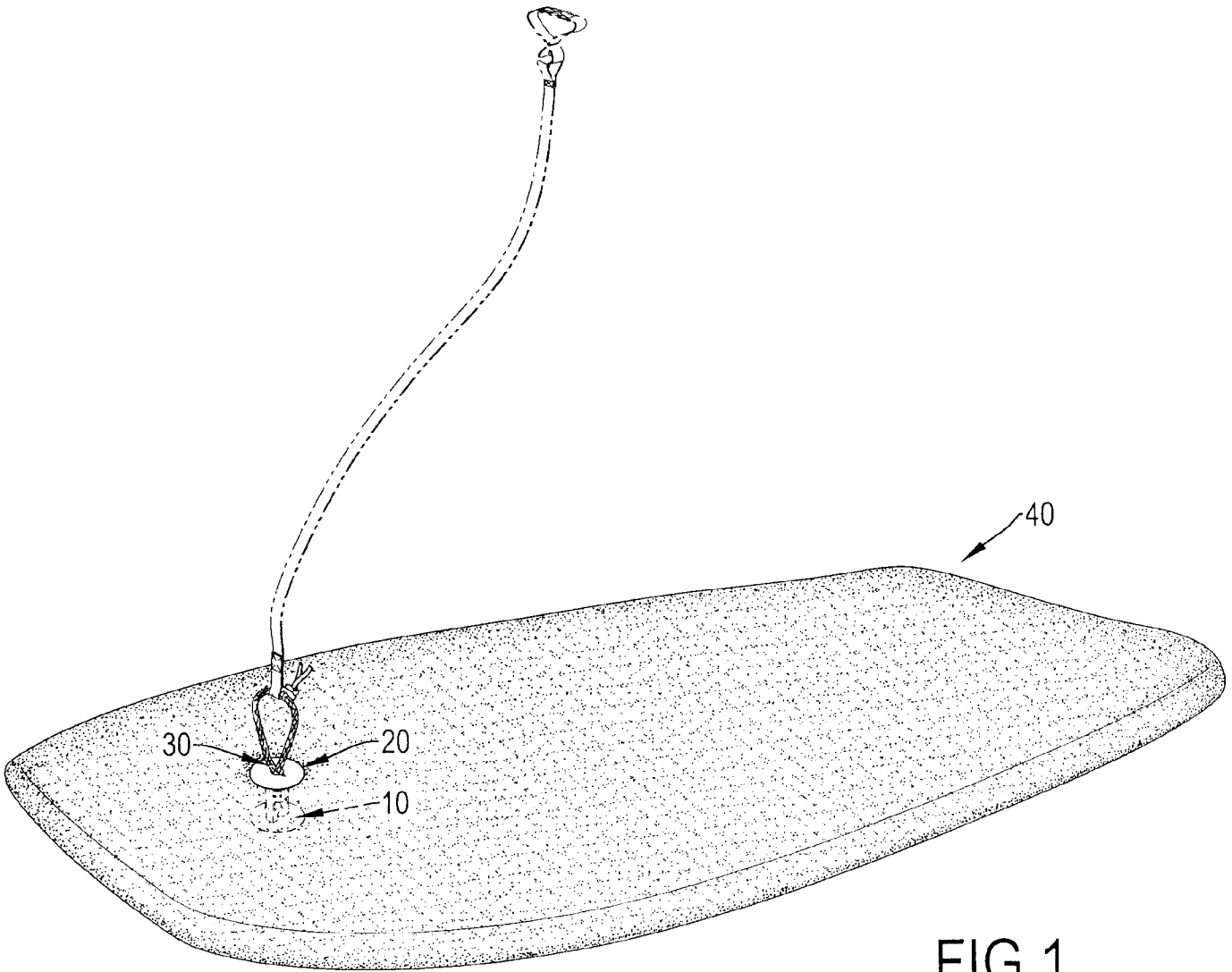
FIG. 1 is an operational perspective view of a leash mount for floating boards in accordance of the present invention partially shown phantoms lines in a body.

With reference to FIG. 1, a leash mount for floating boards (40) in accordance with the present invention comprises a leash tie (30) a base (10) and a cap (20).

Figure 2:
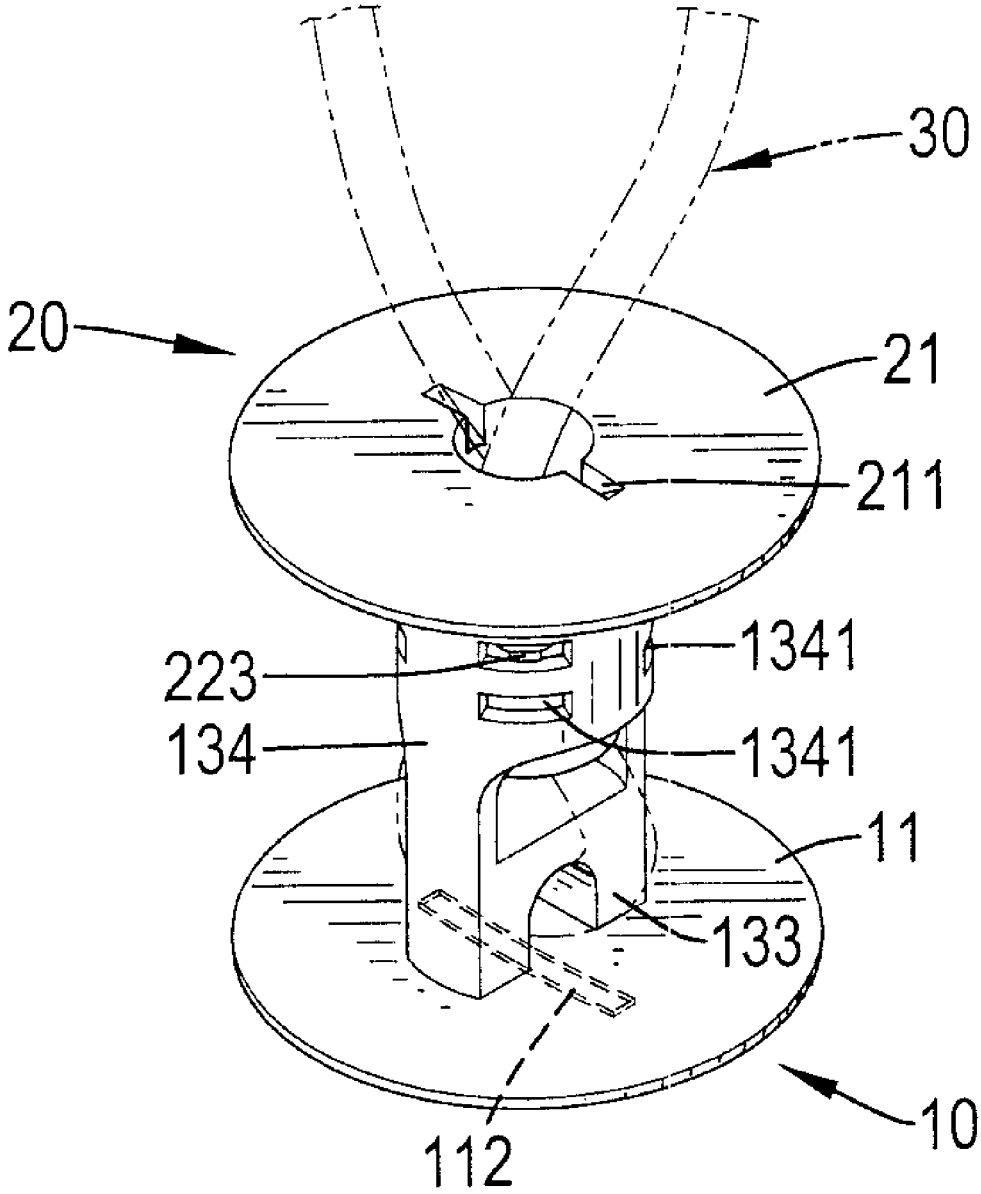
FIG. 2 is an enlarged perspective view of the leash mount for floating boards, a leach tie shown in phantom lines.
Figure 3:
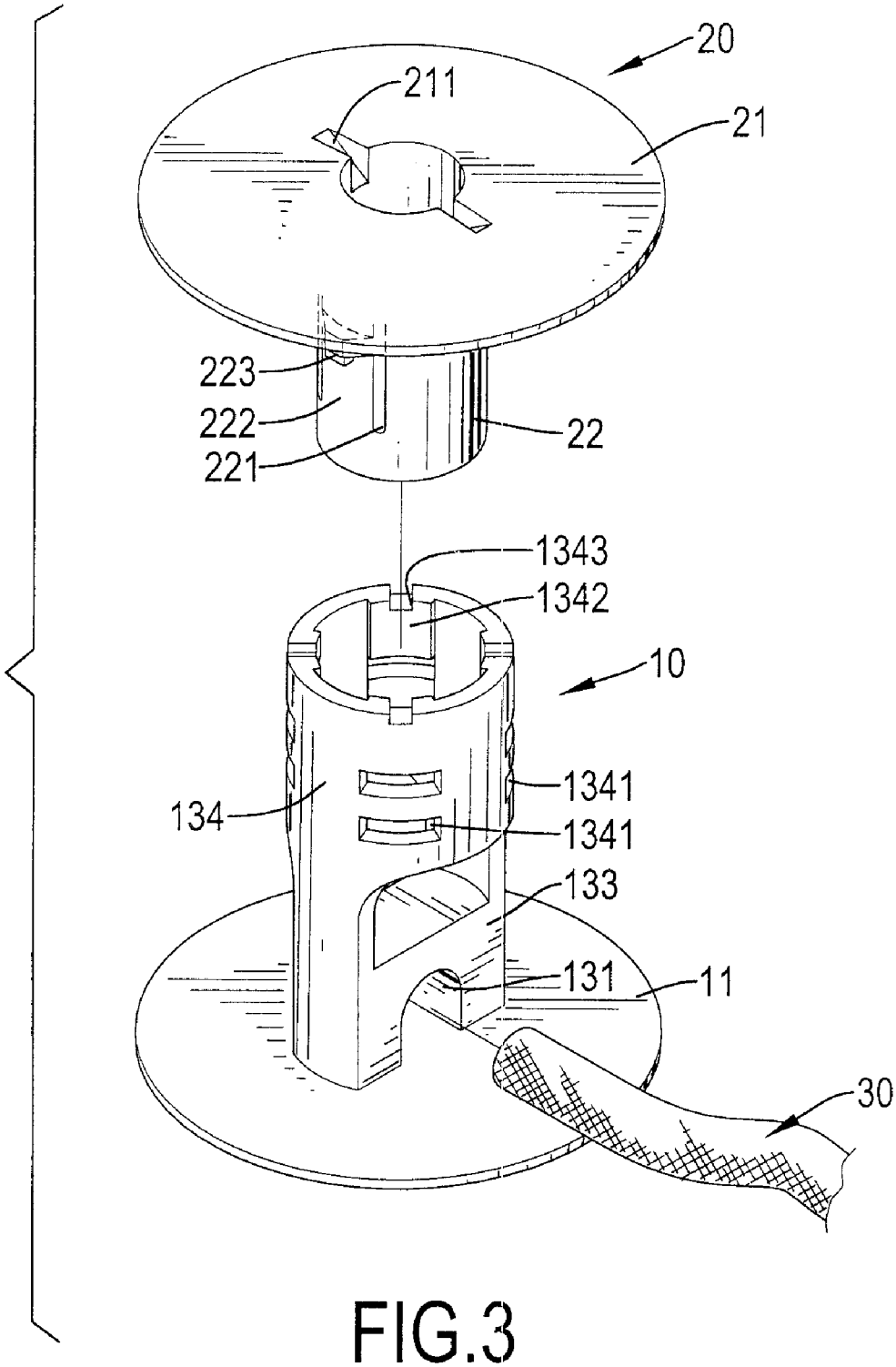
FIG. 3 is an enlarged exploded perspective view of the leash mount for floating boards in FIG. 2.

With further reference to FIGS. 2 and 3, the base (10) is mounted flushly in the floating board (40), and has a seat (11) and a connecting assembly (13).

The seat (11) may be circular and has a top surface, a bottom surface and an optional keyed surface (112). The keyed surface (112) is formed on the bottom surface of the seat and corresponds to a tool such as a coin, hex-key, wrench, screwdriver or the like and is formed on the bottom surface of the seat (11).

The connecting assembly (13) is formed coaxially on and protrudes from the top surface of the seat (11), and has a spacer (133), a leash tie hole (131) and a connecting tube (134).

The spacer (133) has a bottom, a top and an optional through hole and is formed on and protrudes from the top surface of the seat (11). The through hole of the spacer is formed through the top of the spacer (133).

The leash tie hole (131) is formed through the bottom of the spacer (133) and may be arched to prevent unwanted wear.

The connecting tube (134) is a hollow tube, is formed on the spacer (133) may communicate with the top of the through hole of the spacer (133) and has an inner surface, a top edge and at least one pair of mounting recess (1341), multiple optional tabs (1342) and multiple tab recesses (1343). Each pair of mounting recesses (1341) is formed diametrically in two end of a diameter of the inner surface of the connecting tube (134).

In a preferred embodiment, two pairs of mounting recesses (1341) are formed on different diameters and may further comprise another pair of mounting recesses (1341) above each pair of mounting recesses (1341).

Each tab (1342) is formed on and protrudes from the inner surface of the connecting tube (134) above each mounting recess (1341).

Each tab recess (1343) is formed through one of the tabs (1342) at the top edge of the connecting tube (134).

Figure 5:
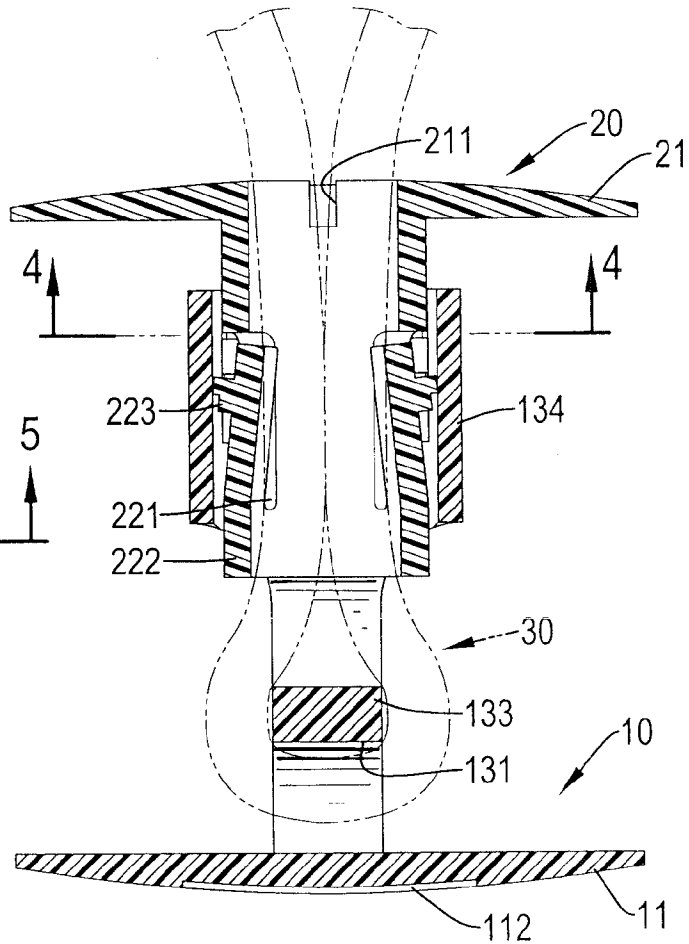
FIG. 5 is a side view in partial section of the leash mount for floating boards along line 5-5 in FIG. 4, shown during assembly with the leash tie in phantom lines.
Figure 4:
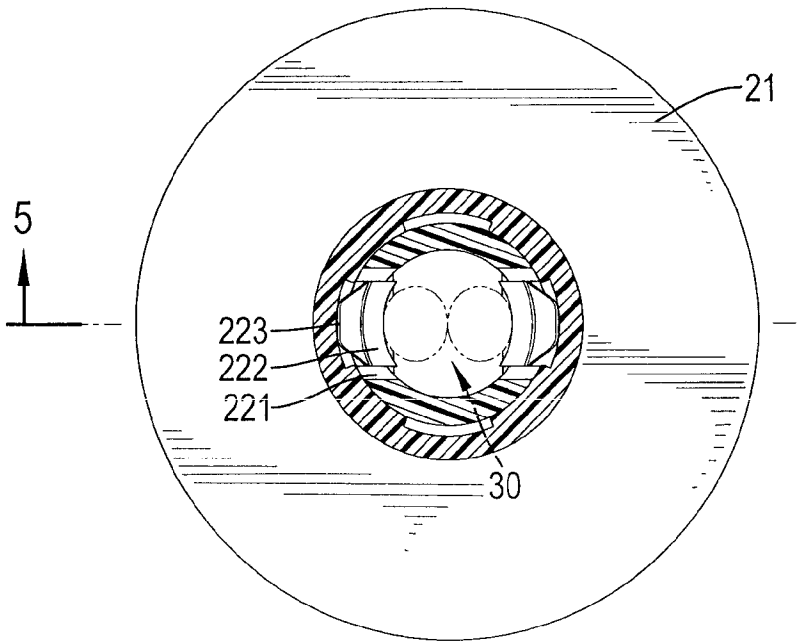
FIG. 4 is a top view in partial section of internal elements of the leash mount for floating boards along line 4-4 in FIG. 4.
Figure 8:
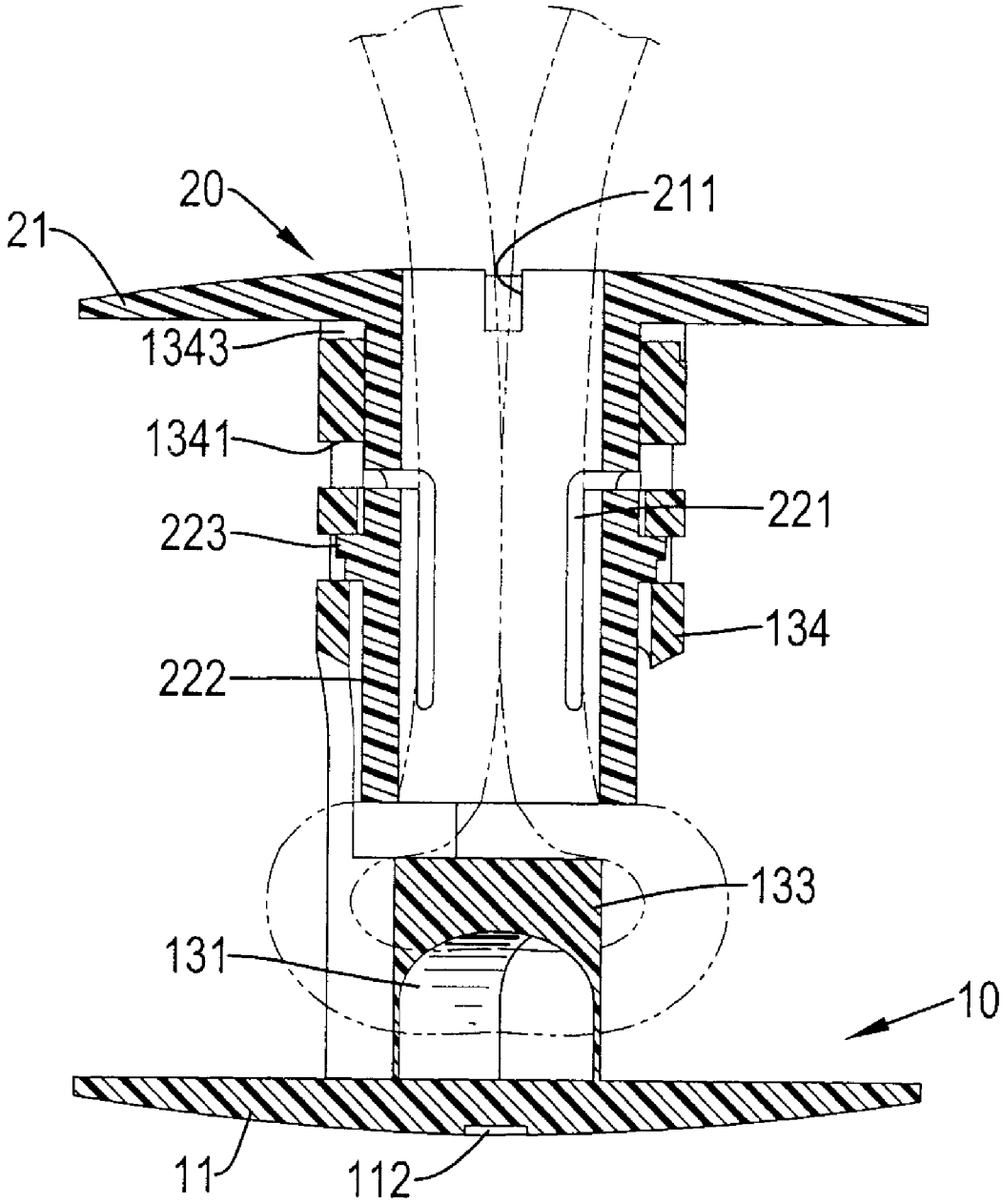
FIG. 8 is an enlarged side view in cross section of the leash mount for floating boards in FIG. 7.
Figure 9:
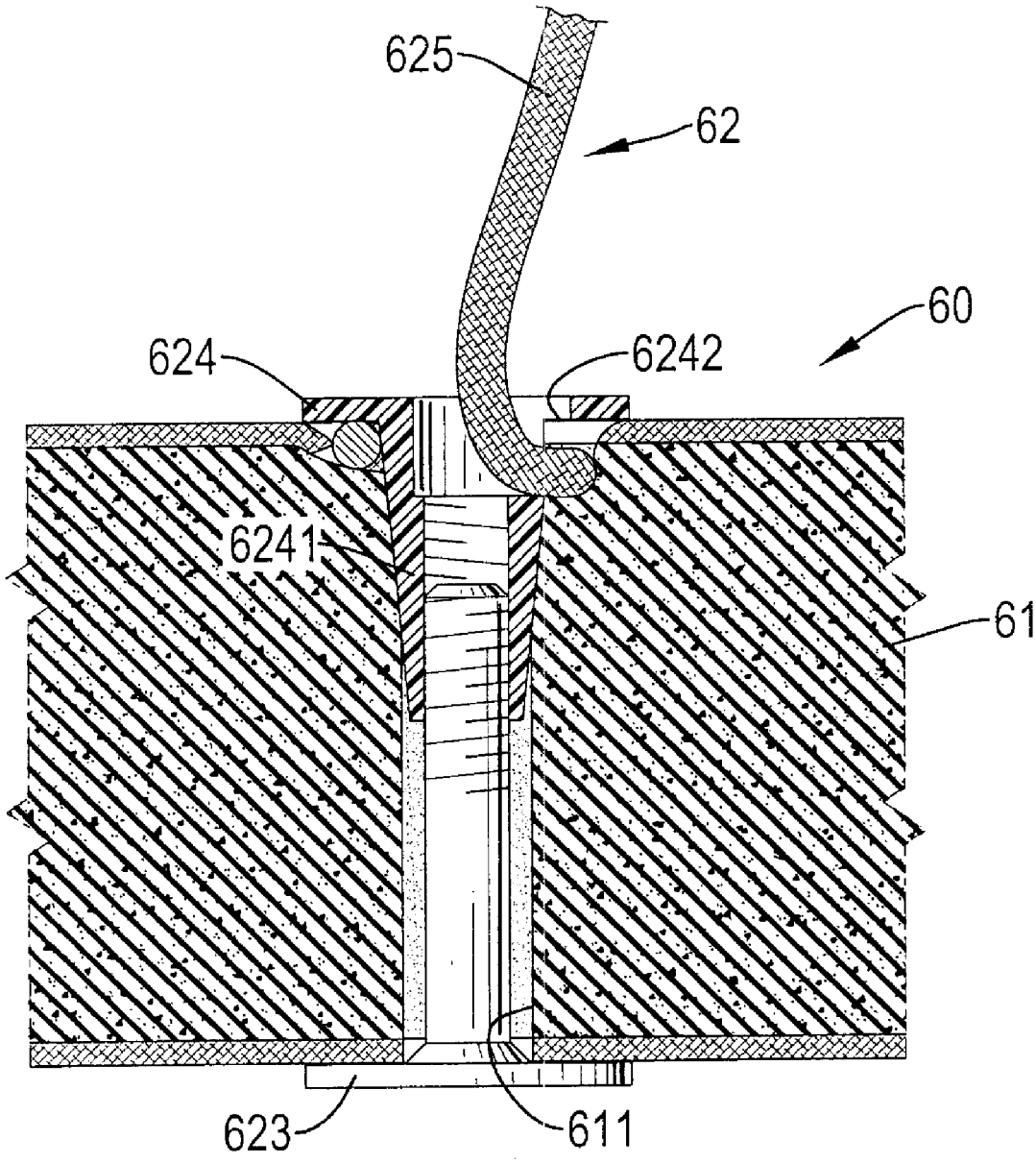
FIG. 9 is an enlarged side view of a conventional leash mounted through a floating board.

With further reference to FIGS. 4, 5 and 8, the cap (20) is rotatably mounted detachably in the connecting tube (134), has a head (21) and a neck (22). The head (21) may be circular and has a top surface, a bottom surface and an optional turning keyed surface (211). The tuning keyed surface (211) is formed on the top surface and corresponds to a tool such as a coin, screwdriver, hex-key, wrench or the like.

The neck (22) is a hollow tube, may be plastic, is formed coaxially on and protrudes from the bottom surface of the head (21), is rotatably mounted detachably in the connecting tube (134) and has an outer surface, two slits (221), two resilient flaps (222). Each slit (221) is inverse U-shaped and formed separately on the outer surface of the neck (22) to define each resilient flap (222). Each resilient flap (222) has an outer surface, a free end and a boss (223). The boss (223) is formed on and protrudes from the outer surface at the free end of the resilient flap (222) and is mounted removably in the corresponding mounting recess (1341) of the connecting tube (131). When the cap (20) is mounted on the base (10), the resilient flaps (222) bend in until the boss (223) is aligned with and clips into the corresponding mounting recess (1341). The leash mount is then held securely.

The leash tie (30) has two ends and is mounted slidably through the leash tie hole (131). Both ends of the leash tie (30) are fed through the connecting tube (134) from opposite sides of the leash tie hole (131). The base (10) may then be mounted in the floating board (40) and both ends of the leash tie (30) are further fed through the neck (22) of the cap (20). Each boss (223) may be aligned to one of the tab recess (1343). The cap (20) is then aligned with and clipped securely into the connecting tube (134) to hold the leash mount securely in the floating board (40). Then both ends of the leash tie (30), extending out of the leash mount may be tied or connected together.

Figure 7:
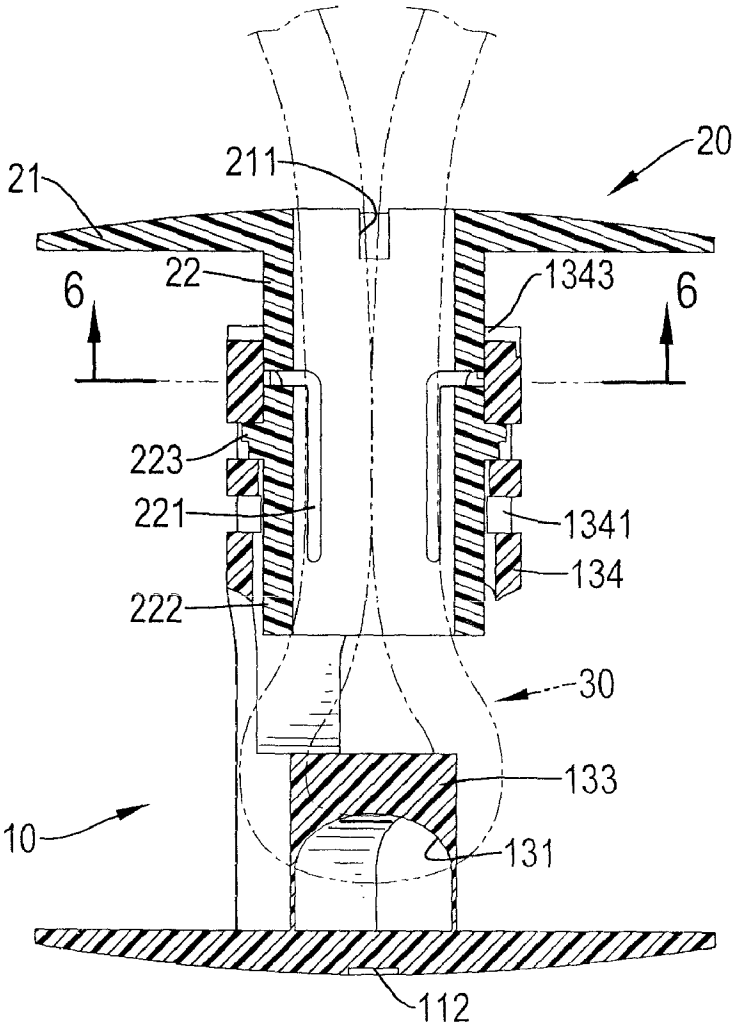
FIG. 7 is side view in cross section of the leash mount for floating boards along line 7-7 in FIG. 6, shown locked and with the leash tie in phantom lines.
Figure 6:
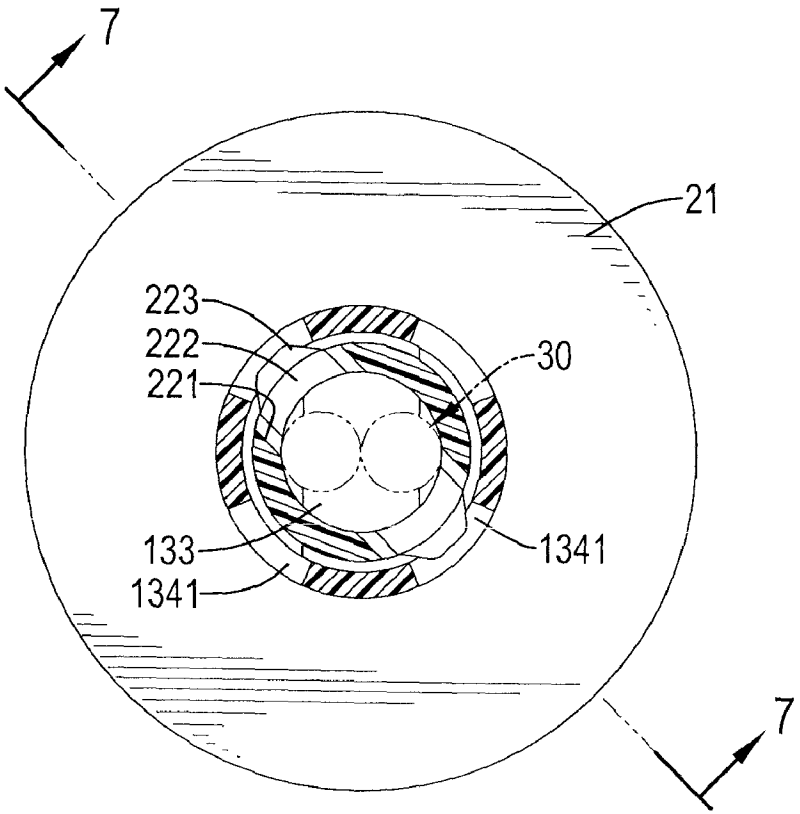
FIG. 6 is a top view in partial section of internal elements of the leash mount for floating boards alone line 6-6 in FIG. 7, shown locked.

With further reference to FIGS. 6 and 7, when the person cleans or performs maintenance on the leash mount, they only need to turn the base (10), or the cap (20), until the bosses are removed from the mounting recesses (1341) to disassemble the leash mount. Further, when the base (10) is turned, then the bosses (1342) may against the tabs (1342) and clip the bosses (1342) with mounting recesses (1341) above the tabs (1342) more easily.

The preferred embodiment of the leash mount may be applied to many designs of floating boards (40) with different thicknesses since pairs of mounting recesses (1341) are formed at different levels on the connecting tube (13).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A leash mount for floating boards comprising
- a base having
  - a seat having
    - a top surface; and
    - a bottom surface; and
  - a connecting assembly being formed coaxially on and protruding from the top surface of the seat and having
    - a spacer being formed on and protruding from the top surface of the seat and having a bottom and a top; and
    - a connecting tube being a hollow tube being formed on the spacer and having
      - an inner surface;
      - a top edge; and
      - at least one pair of mounting recess being formed diametrically in the inner surface of the connecting tube; and
- a cap being rotatably mounted detachably in the connecting tube and having
  - a head having
    - a top surface; and
    - a bottom surface; and
  - a neck being a hollow tube formed coaxially on and protruding from the bottom surface of the head, being rotatably mounted detachably in the connecting tube and having
    - an outer surface;
    - two slits being formed relatively on the outer surface of the neck alone the longitudinal direction, and each being inverse U shaped;
    - two resilient flaps, each being defined by one of the slits and each having
      - an outer surface;
      - a free end; and
      - a boss being formed on and protruding from the outer surface at the free end and being mounted removably in the mounting recess.

2. The leash mount for floating boards as claimed in claim 1, wherein the connecting tube has two pairs of mounting recesses formed on different diameters of the connecting tube.

3. The leash mount for floating boards as claimed in claim 2, wherein the connecting tube further has two pairs of mounting recesses formed above the two pairs of mounting recesses.

4. The leash mount for floating boards as claimed in claim 3 wherein the neck is a plastic hollow tube.

5. The leash mount for floating boards as claimed in claim 4, wherein the spacer further has a through hole being formed through the top of the spacer and communicating with the connecting tube.

6. The leash mount for floating boards as claimed in claim 5, wherein the spacer further has a leash tie hole being formed through the bottom of the spacer.

7. The leash mount for floating boards as claimed in claim 1, wherein the head of the cap further has a turning keyed surface formed on the top surface.

8. The leash mount for floating boards as claimed in claim 1, wherein the seat of the base further has a keyed surface formed on the bottom surface of the seat.

9. The leash mount for floating boards as claimed in claim 6, wherein
- the head of the cap further has a turning keyed surface formed on the top surface; and
- the seat of the base further has a keyed surface formed on the bottom surface of the seat.

10. The leash mount for floating boards as claimed in claim 9, wherein the connecting tube further has
- multiple tabs, each being formed on and protruding from the inner surface of the connecting tube above one of the mounting recesses; and
- multiple tab recesses, each being formed through one of the tabs at the top edge of the connecting tube.

* * * * *